United States Patent [19]

Hashimoto et al.

[11] 4,330,782

[45] May 18, 1982

[54] FULLY-AUTOMATIC ANTENNA DRIVING DEVICE

[75] Inventors: Atsumi Hashimoto; Kazumasa Takagi, both of Yokohama, Japan

[73] Assignee: Nissan Motor Co., Ltd., Japan

[21] Appl. No.: 174,508

[22] Filed: Aug. 1, 1980

[30] Foreign Application Priority Data

Aug. 6, 1979 [JP] Japan ..... 54/108328[U]

[51] Int. Cl.[3] ..... H01Q 1/32

[52] U.S. Cl. ..... 343/715; 343/903; 318/468

[58] Field of Search ..... 343/900-903, 343/711-715, 889; 318/266, 267, 467, 468; 325/365

[56] References Cited

U.S. PATENT DOCUMENTS 4,126,820 11/1978 Hormann et al. ..... 318/468
4,198,637 4/1980 Sand ..... 343/903

FOREIGN PATENT DOCUMENTS 2640995 3/1978 Fed. Rep. of Germany ..... 343/903
2641071 3/1978 Fed. Rep. of Germany .

*Primary Examiner*—David K. Moore
*Attorney, Agent, or Firm*—Lane, Aitken, Kice & Kananen

[57] ABSTRACT

A fully-automatic antenna driving device comprises a radio switch consisting of a push type switch which is on only during being pushed, a self-holding circuit for self-holding an excited condition by the turning on of the push type switch, and a further push type switch which is off only during being pushed, thereby preventing an antenna from being extended only by turning on an ignition switch.

5 Claims, 2 Drawing Figures

FULLY-AUTOMATIC ANTENNA DRIVING DEVICE

BACKGROUND OF THE INVENTION

1. Field of the Invention

This invention relates to a fully-automatic driving device for a power-driven antenna of a radio for use in a vehicle.

2. Description of the Prior Art

A system for automatically extending and retracting an antenna arranged on a vehicle body for a radio in a vehicle has been known as shown in FIG. 1.

With this arrangement, when an ignition switch 1 is turned on and a radio switch 2 of a lock type is then switched on, a current is supplied from a battery 3 through these switches 1 and 2 to a radio 4 to actuate it and simultaneously a current is supplied to an exciting coil 5*a* of a relay 5 in the same manner to close a normally opened contact 5*b*. At this moment, an antenna rod has been retracted and hence a limit switch 6 has been closed to the on state so that a driving current flows from the battery 3 between terminals 7*a* and 7*c* of a motor 7 through the switches 1 and 2, contact 5*b* and the limit switch 6 to extend the antenna rod.

When the antenna rod extends to a predetermined length, the limit switch 6 is opened or turned off to shut off the driving current for the motor 7 so as to stop the extension of the antenna rod.

With the radio 4 in the operative condition and the extended antenna rod, when the ignition switch 1 or the radio switch 2 is turned off, the current supply to the radio 4 and the exciting coil 5*a* of the relay 5 is shut off to turn off the radio 4 and simultaneously to close a normally closed contact 5*c*. At this moment, the antenna rod has extended and hence a limit switch 8 has been closed to an on state, so that the current flows from the battery 3 between terminals 7*b* and 7*c* of the motor 7 through the contact 5*c* and the switch 8 now to retract the antenna rod.

When the antenna rod has been retracted to a predetermined length and housed in the body, the limit switch 8 is opened to shut off the driving current for the motor 7 so as to stop the retraction of the antenna rod.

With the driving device of the prior art as described with reference to FIG. 1, the antenna rod is adapted to extend or retract automatically in response to the on and off of the ignition switch 1 and radio switch 2. With such a driving device, the ignition switch is often turned off to stop an engine without switching off the radio switch 2. In this case, the antenna rod will extend at the moment when the ignition switch is again turned on for starting the engine, because of the lock type radio switch 2 remaining in an on condition. If a driver is not aware of the extension of the antenna, there is a danger to a person near the antenna and a risk of a touch of the antenna with a shutter of a garage when a car is being driven into or out of the garage.

SUMMARY OF THE INVENTION

It is therefore an object of the invention to provide an improved fully-automatic driving device for a power-driven antenna, which eliminates all the disadvantages of the prior art by an improved construction that a radio switch is turned off without fail in response to the shutting off of an ignition switch and an antenna rod is thus not extended only by turning on the ignition switch.

The invention will be more fully understood by referring to the following detailed specification and claims taken in connection with the appended drawings.

DETAILED DESCRIPTION OF THE PREFERRED EMBODIMENT

Figure 1:
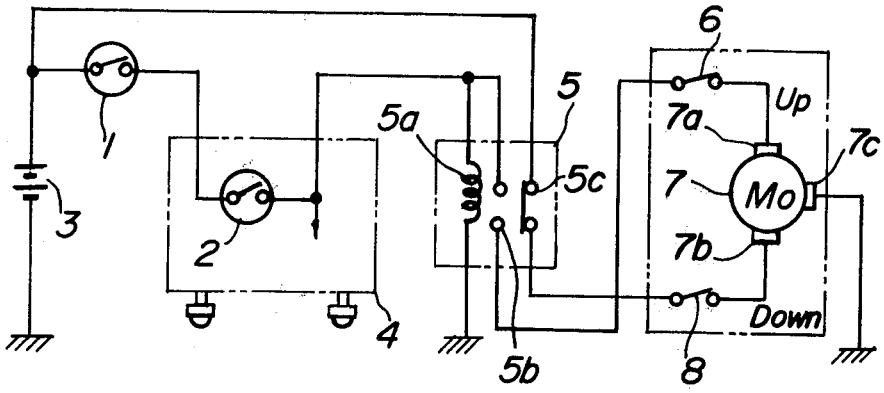
FIG. 1 PRIOR ART
FIG. 1 is a circuit of a device of the prior art as mentioned above.
Figure 2:
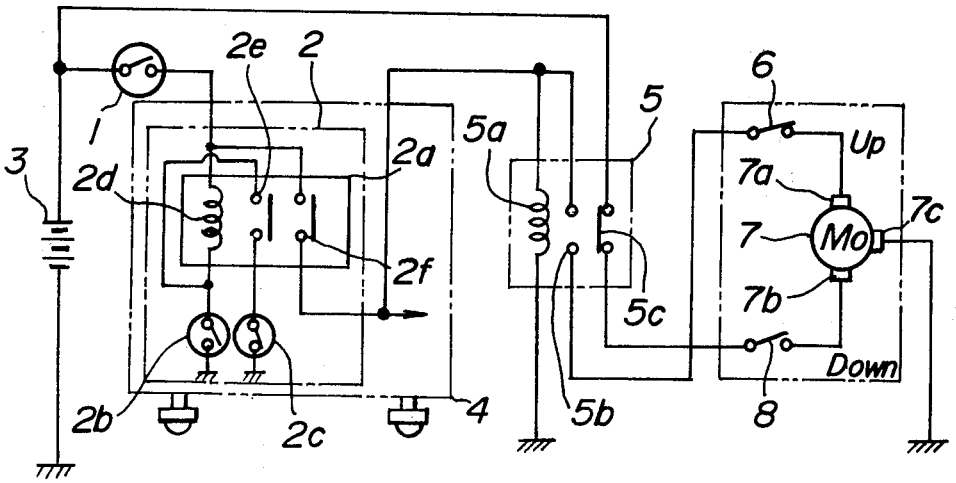
FIG. 2 is a circuit of a device of one embodiment of the invention.

Referring to FIG. 2 illustrating one embodiment of the invention, an antenna driving circuit comprises an ignition switch 1, a battery 3, a relay 5, a limit switch 6, a motor 7, a limit switch 8 and the like in the same manner as that in FIG. 1.

However, a radio switch 2 different from that in FIG. 1 consists of a relay 2*a*, a switch 2*b* for turning on a radio and a switch 2*c* for turning off the radio. The switch 2*b* is a push type switch which is on only while pushed or depressed and automatically turns off when it is released. On the other hand, the switch 2*c* is off only while pushed.

With this arrangement, when the ignition switch 1 is turned on and the radio switch 2*b* is pushed to turn on and thus turn on the radio, a current flows through the battery 3, the ignition switch 1, an exciting coil 2*d* of the relay 2*a* and the switch 2*b* to excite the relay 2*a* so as to close normally opened contacts 2*e* and 2*f*. The current is therefore supplied from the battery 3 through the ignition switch 1 and contact 2*f* to the radio 4 and relay 5 to operate the radio 4 and simultaneously extend an antenna rod in the same manner as in FIG. 1.

Once the relay 2*a* has been excited, even if the switch 2*b* is released to turn off, the current still flows through the battery 3, the ignition switch 1, the coil 2*d*, the contact 2*e* and the switch 2*c* to form a self-holding circuit for the relay 2*a* keeping it in an excited condition so as to maintain the contacts 2*e* and 2*f* closed. Accordingly, after the switch 2*b* has once been pushed to turn on, even if the switch 2*b* is turned off, the contact 2*f* will be kept closed to continue supplying the current to the radio 4 and the relay 5.

Under a condition that the radio 4 is being operated and the antenna rod has been extended, the switch 2*c* is pushed to turn off the radio, so that the exciting current is shut off to release the excited condition of the relay 2*a* so as to open the contacts 2*e* and 2*f*. As a result, the current supply to the radio 4 and the relay 5 is interrupted to make the radio 4 inoperative as that shown in FIG. 1 and simultaneously a current flows through a contact 5*c* and the limit switch 8 to the motor 7 to retract the antenna rod.

On the other hand, under the condition that the radio 4 is on and the antenna rod has been extended, the ignition switch 1 is turned off, so that the current flowing through the coil 2*d* is interrupted to release the self-holding circuit so as to open the contacts 2*e* and 2*f*, with the result that the current to the radio 4 and the relay 5 is interrupted. Therefore, the exciting coil 5*a* of the relay 5 is deenergized to close the contact 5*c*, so that a current flows through the contact 5*c* and the limit switch 8 to the motor 7 to retract the antenna rod.

From this condition, even if the ignition switch is turned on to start an engine, the switch 2*b* for the radio is never turned on unless the switch 2*b* is pushed, so that exciting current never flows through the relay 2*a* and therefore the contact *2f* is kept open. As the result, current is never supplied to the radio 4 and relay 5, so that the radio is not operated and the antenna rod is not extended.

As can be seen from the above description, according to the invention even if an ignition switch is turned on to start an engine, an antenna rod is not extended unless a switch *2b* is pushed to turn a radio on. In this case, therefore, there is no longer any risk of an extension of an antenna rod against a personnel near the antenna or a contact of the antenna with, for example, a shutter of a garage when a car is driven thereinto or out thereof.

While the invention has been particularly shown and described with reference to preferred embodiments thereof, it will be understood by those skilled in the art that the foregoing and other changes in form and details can be made therein without departing from the spirit and scope of the invention.

What is claimed is:

1. In a fully-automatic antenna driving device for extending and retracting an antenna for a radio in a vehicle of the type which includes an antenna driving circuit operative in response to openings and closings of an ignition switch and a radio switch in series therewith and connected to a source of power, to extend and retract an antenna rod by exciting an antenna-driving relay coil having at least a pair of relay contacts in circuit with a motor for alternately extending or retracting an antenna rod in response to the respective open or closed states of said relay contacts, the improvement wherein said radio switch includes:

a first normally off push type switch for turning on said radio, said first switch being on only when pushed;

a second normally on push type switch for turning off said radio, said second switch being off only when pushed; and self-holding circuit means in circuit with said ignition switch, said first switch, said second switch, and said antenna-driving relay coil for (a) operating the radio and causing said antenna-driving coil to extend the antenna rod when said ignition switch is on and said first switch is pushed and maintaining such operations even after said first switch is released; (b) causing said antenna driving antenna relay to retract said antenna rod when said second switch is pushed; and (c) deenergizing said antenna driving relay coil when said ignition switch is turned off to retract the antenna rod even if radio is on.

2. The device as set forth in claim 1 wherein said self-holding circuit includes a self-holding relay coil in circuit with said ignition switch and said first switch and a first normally open contact which is closed to energize said antenna driving relay coil when said self-holding relay coil is energized by pushing said first switch when said ignition switch is closed.

3. The device as set forth in claim 2 further including a second normally open contact in circuit with said second switch, said second contact being closed when said self-holding relay coil is energized and maintaining said self-holding relay coil is an energized state after said first switch is released.

4. In a fully-automatic antenna driving device including antenna driving means for extending and retracting an antenna of a radio in a vehicle, said antenna driving means including an antenna driving circuit operative in response to openings and closings of an ignition switch and a radio switch in series with said antenna driving circuit, the improvement wherein the radio switch for turning on said radio includes a first normally off push type switch which is on only when pushed, the improvement further comprising a self-holding circuit means for self-holding an excited condition caused by the turning on of said normally off push type switch, and a second separate normally on push type switch which is off only when pushed, said ignition switch, said first switch, said self-holding circuit means, and said second switch being connected so that even if said ignition switch is turned on, said antenna is not extended unless said first push type switch is turned on.

5. A fully-automatic antenna driving device as set forth in claim 4, wherein said self-holding circuit consisting of a relay comprising an exciting coil excited by pushing the first push type switch and normally open contacts closed by the excitation of said exciting coil.

* * * * *